US006736280B1

(12) United States Patent
Zapata

(10) Patent No.: US 6,736,280 B1
(45) Date of Patent: May 18, 2004

(54) TAMPER-PROOF CAP FOR BOTTLES

(76) Inventor: Felipe Lopez Zapata, Rua Imperatriz Leopoldina, 426 Vila Leopoldina, São Paulo (BR), 05305-00

( * ) Notice: Subject to any disclaimer, the term of this patent is extended or adjusted under 35 U.S.C. 154(b) by 0 days.

(21) Appl. No.: 10/322,615

(22) Filed: Dec. 19, 2002

(51) Int. Cl.[7] ..... B65D 41/34
(52) U.S. Cl. ..... 215/252; 215/256
(58) Field of Search ..... 215/252, 253, 215/254, 256, 258, 324, 354; 222/265, 266, 276

(56) References Cited

U.S. PATENT DOCUMENTS 3,601,273 A * 8/1971 Kutcher ..... 215/252
4,509,654 A * 4/1985 Maguire ..... 215/253
4,801,030 A * 1/1989 Barriac ..... 215/252
5,080,246 A * 1/1992 Hayes ..... 215/252
5,129,530 A * 7/1992 Fuchs ..... 215/252
5,205,426 A * 4/1993 McBride et al. ..... 215/252
5,660,289 A * 8/1997 Spatz et al. ..... 215/252
5,836,468 A * 11/1998 Bosl et al. ..... 215/253
5,950,850 A * 9/1999 Takamatsu et al. ..... 215/252
6,053,344 A * 4/2000 Gregory et al. ..... 215/252
6,224,802 B1 * 5/2001 Gregory et al. ..... 264/156
6,308,848 B1 * 10/2001 Parrinello ..... 215/252
6,325,225 B1 * 12/2001 Druitt et al. ..... 215/252

* cited by examiner

*Primary Examiner*—Kien Nguyen
(74) *Attorney, Agent, or Firm*—Shapiro Cohen; Dennis R. Haszko

(57) ABSTRACT

A tamper-proof cap for bottles with a body defined by a cylindrical base, an upper closing, an anti-sliding external surface, an internal adequate thread with interrupted sections, above which there is an internal sealing layer, while its lower end has an extension equally circular, which determines the sealing belt with an outwards increase of thickness of the wall and a circular cut line with breakable parts; the sealing belt presents, right above its lower end, a series of articulated blades designed radially inwards, spaced equidistantly, as well as presenting its base configured with a dimensional detail cooperating with the articulation thereof upwards, which makes said blades operating as locking components between the cap and the bottle; each blade presents at least one anti-attrition thread or flange, further considering that each breakable element is formed by a vertical part, which, in conjunction with the weakened points, allows the sealing belt to be destroyed when removing the cap.

6 Claims, 5 Drawing Sheets

TAMPER-PROOF CAP FOR BOTTLES

BACKGROUND OF THE INVENTION

1. Field of the Invention

The present invention relates to tamper-proof caps for bottles. More particularly, this invention includes technical and functional improvements especially developed for the optimization of a specific type of cap with sealing device attached. The present invention is to be used in various types of disposable or recyclable bottles made of glass or plastic for food products or not, including drugs and similar products, all presenting easy flow.

2. Description of the Prior Art

As it is known, there are various types of caps with sealing devices attached to the lower end of the base. Many caps include where the sealing device can be a belt or ring consisting in a continuation of the cylindrical base of the body of the cap, attached thereto only by "bridges" or small breakable "linkages", with various articulated trapezoidal blades in the internal side. Each blade includes the largest side interconnected to the sealing device or articulated ring, while the smallest side is radially oriented inward, with a certain inclination upward. These blades, in addition to being positioned near the lower end of the sealing device, are also distributed equidistantly. The blades function as the main locking component between the cap and the bottle-neck. In other words, when screwing the cap to the neck, the blades articulate upwards to a vertical position. However, this occurs only when the blades are passing through a circular locking groove or collar existent in the neck of the bottle and, after passing through said circular collar, the blades tend to return to a horizontal position. Therefore, each blade is inclined inward sufficiently to touch the wall of the neck and under the circular collar. This demonstrates the irreversible lock between the cap and the bottle because when the cap is unscrewed, the free vanes of the blades are sustained under said collar. Further, upon the continuity of the unscrewing process, the belt of the base is separated, which means that the sealing device is ruptured in the linkages. Accordingly, the cap may be totally unscrewed, as well as the sealing device, which demonstrates the first opening of the cap.

There is no doubt that the caps manufactured according to the current technique have sufficient details for the correct closing of the bottle, which makes it inviolable or tamper-proof However, there is an inconvenience defined herein as "placement attrition." In other words, during the bottling process, or more specifically during the closing or sealing process of the bottle, it was possible to verify that the placement of the conventional cap by high-speed machines resulted in bottling failures or a "considerable attrition." As such placement attrition occurs during the bottling process, special corrective measures including additional mechanical components are often required to alleviate such attrition.

When applying a conventional cap, it shall be screwed until the end, in order that its vanes may be locked under the collar. Therefore, the surface of each blade slides on the corresponding parts of the bottle, which demonstrates an attrition coefficient substantially high in each blade.

To solve the aforementioned problem, the cap described in the Brazilian document M.U. 8.001.668-5 dated Aug. 15, 2000 was created where a constructive disposal was especially developed in order to drastically reduce the attrition coefficient. Therefore, each one of its vanes has its external side (or the side towards the wall of the neck) with an anti-attrition thread or flange, positioned medianly (attached along a central axis) and developed from its articulated base to the open edge. With this detail, a special effect is produced in each vane during the process of application of the caps by high-speed machines. Specifically, the coupling of the cap occurs with low attrition because the contact area between the vane and the neck or collar of the neck is limited only to the thread.

On the other hand, although the thread has been developed in order to reduce the attrition between the cap and the collar of the bottle, a new improvement was verified. In other words, with the introduction of the thread, the blade reinforced its structure. The thread functions as a reinforcement, which means that even if the vane has a reduced thickness, its locking effect is maintained efficiently.

Although the cap has fulfilled different objectives and solved a specific technical problem, after some time it was possible to verify that some of its characteristics could be improved even more, since as it is known, tamper-proof or inviolable plastic caps with various configurations are available on the market. However, all of them, including the type aforementioned, do not have specific characteristics for the recycling process thereof, nor other specific details that, additionally to the contribution for an easier opening, removal and, use of the cap do not present means for the complete destruction of the sealing ring.

In general, when the caps used on the market are opened including the aforementioned cap, the ring remains attached to the neck. In this condition, the set offers conditions and certain facility to violate the package, logically upon the "reassembling", which is the bonding of the ring to the lower edge of the cap Further, after that, the cap is replaced on the bottle, providing to any unprepared person the impression of having an apparently intact cap. However, in caps with similar characteristics, which means with border or sealing ring with thick wall similar to the thickness of the cylindrical wall of the cover, these points are vertically weakened.

To solve the above mentioned problem, the technical analysis also included different caps with violable sealing ring in the vertical position, however, these points vertically weakened are created through a vertical cutting and/or notching process using a complicated mechanical cutting systems with knife. Such cutting systems, even considering automation, are significantly involved in the manufacturing process of the cap, as the vertical cutting process requires specific equipment and a process control point, and it is not easily repeated.

SUMMARY OF THE INVENTION

One aspect of this invention is to improve the vertical weakening points of the sealing belt.

A second aspect of this invention is to eliminate the entire knife cutting process for the formation of points vertically weakened.

A third aspect of the invention is to form breakable vertical points in the sealing belt concomitantly to the injection process of the cap.

A fourth aspect of the invention is to provide a strategic distribution of the set of vertically weakened points, in order that each one of them may be positioned and oriented adequately between the spaces of the internal blades.

A fifth aspect of the invention is to define an efficient cross section to each vertically weakened point, provided that the cross section shall combine two details. The cross section details include one in the internal side and other in the external side, both as relief of material. The internal and external sides form a weakened vertical line designed for breaking the sealing belt, considering that both internal and external sides are obtained concomitantly to the injection process of the cap, therefore creating an advantageous way for defining a cap with sealing belt breakable in various vertical points.

This improved cap, in addition to solving a few inconveniences related to the usual caps, is also designed to resolve the recycling problem and provide ease for the opening, removal, and use of the cap, and destructing the sealing ring in sections. Consequently, the details demonstrating the opening of the bottle are substantially more evident, and due to the destruction of the sealing belt, its reconstitution in a possible attempt of violation of the content of the bottle is impossible.

With the alterations proposed herein, when opening the bottle, the vertical rupture of the sealing belt occurs in one or more locations and, at the same time, the partial separation of the ring of the cap also occurs due to the rupture of the internal vanes.

With these characteristics, this cap is ideal for the burgeoning market of recyclable bottles and also for the present great need for producing packages with superior post-consumption recycling characteristics.

For a better comprehension of this invention, a detailed description thereof is presented below, with references to the drawings attached hereto, where:

DETAILED DESCRIPTION OF THE INVENTION

Figure 1:
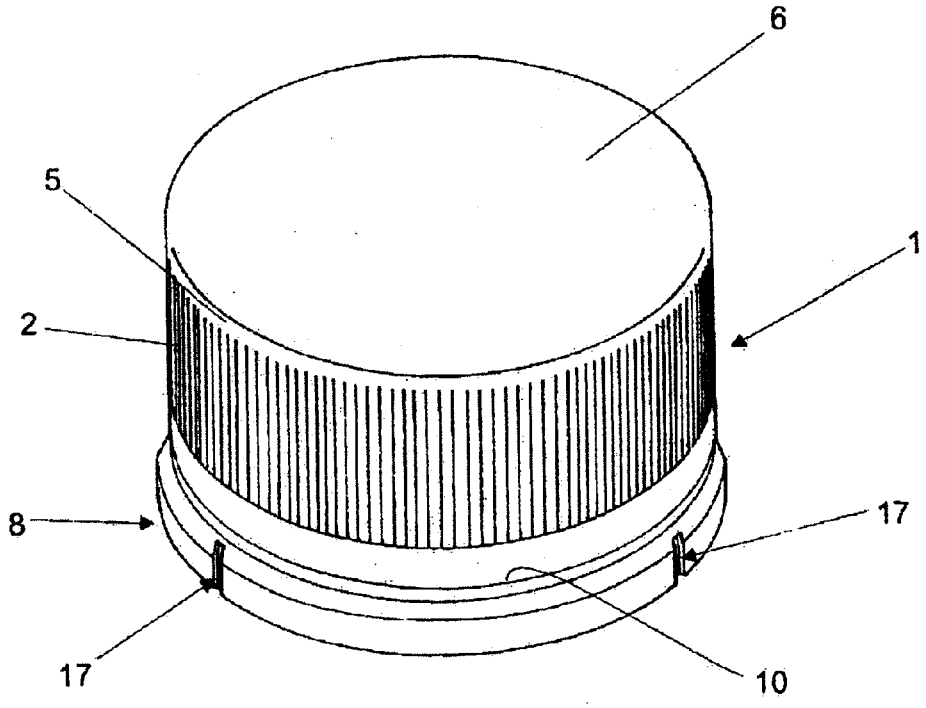
FIG. 1 illustrates a perspective view of the cap from an upper angle.
Figure 2:
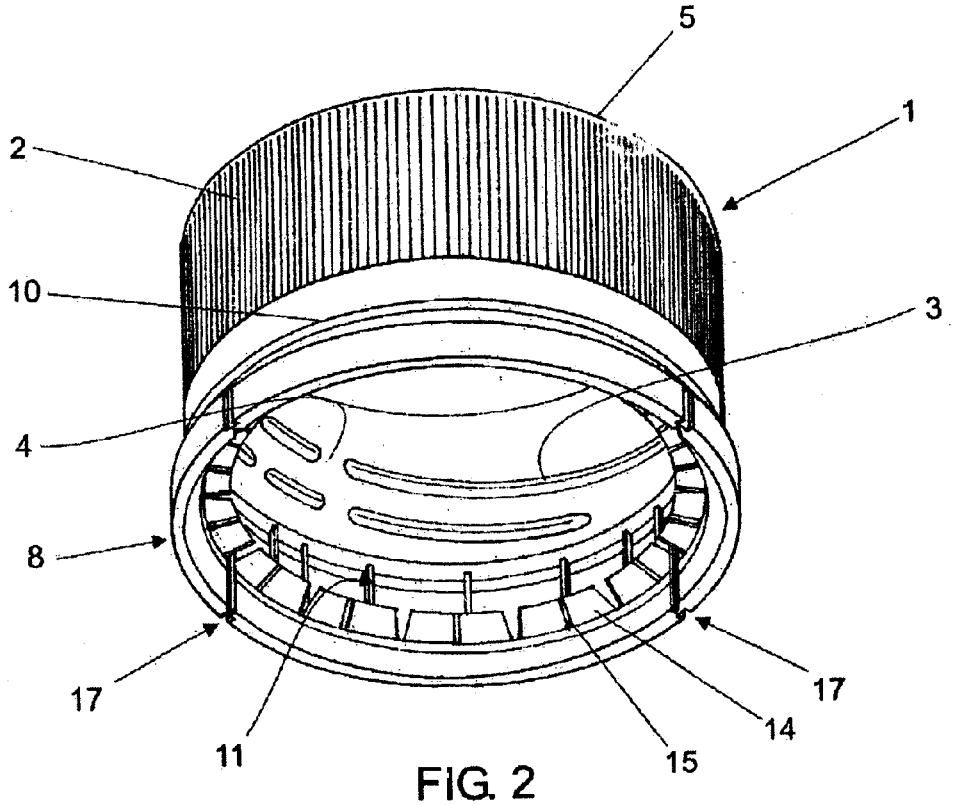
FIG. 2 consists in a different perspective view of the cap from a lower angle.
Figure 3:
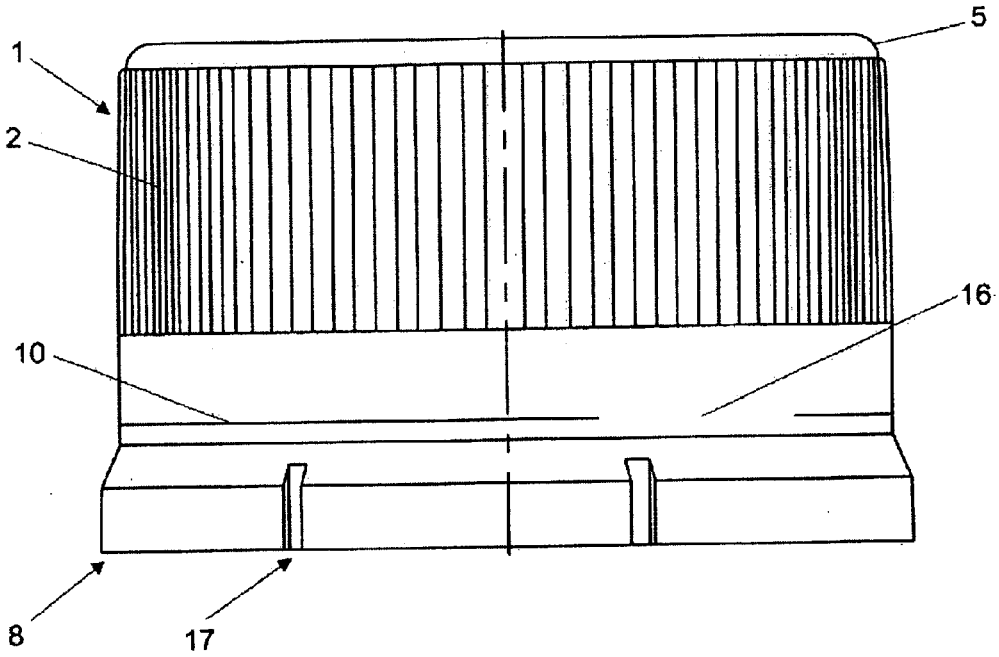
FIG. 3 represents a side view of the cap, with its external details.
Figure 4:
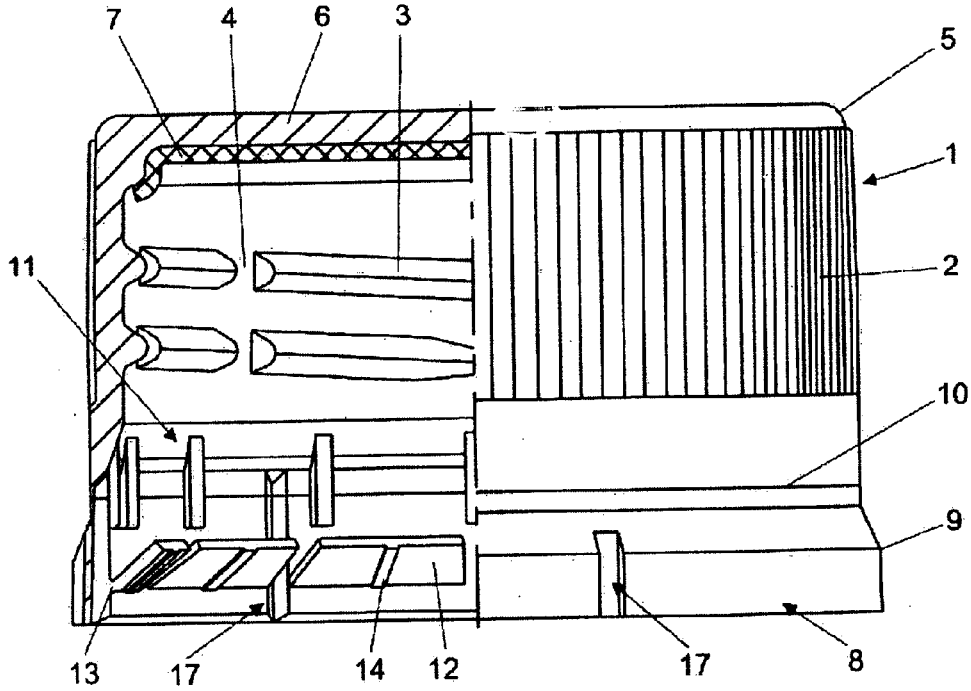
FIG. 4 demonstrates another side view in cross section cut, highlighting its internal details.
Figure 5:
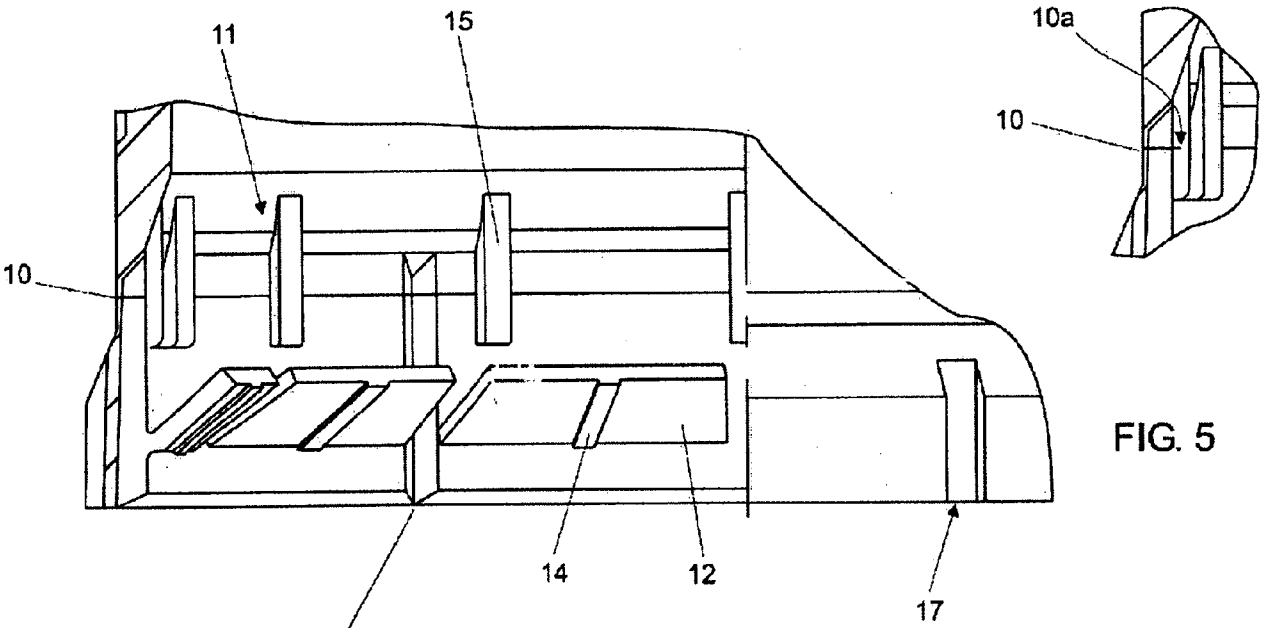
FIGS. 5 and 6 demonstrate amplified details, highlighting the invention.
Figure 6:
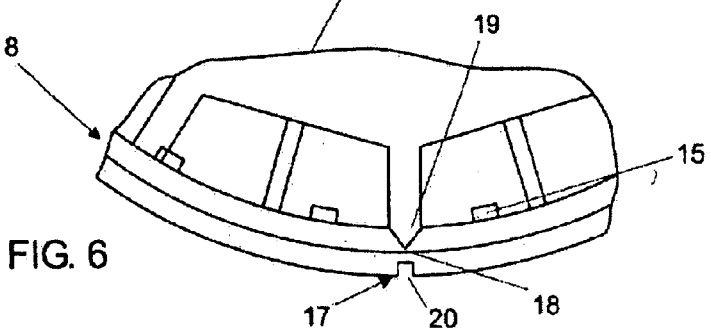

Pursuant to these illustrations and its details, more particularly FIGS. 1 to 4, the present invention includes a cylindrical single piece injected in plastic material defined by a first part composed by a cylindrical vertical base (1), with an external anti-sliding surface (2), and an internal adequate thread (3) interrupted by sections (4), appropriate for the escape of pressure when the bottle to be closed with the cap contains any carbonated liquid.

The superior end of the cylindrical base (1) is completely closed by a circular wall (6) with a round-shape edge (5), and a respective internal sealing layer (7) placed against the circular wall. The lower end of the base (1) has a circular extension with an internal and an external surface, forming a sealing belt (8) presenting an outwards slight increase on the its wall thickness (9), and a circular cut line (10) right above the increased thickness (9), defining the separation point between the sealing belt (8) and the cylindrical base (1). However, the cylindrical base and the sealing belt are maintained interconnected through breakable elements (11).

The sealing belt (8) presents, in the internal surface, adjacent to its lower end, a plurality of articulated blades (12), projected radially inwards. The blades are equidistantly spaced, and each one of them presents a base configured with a dimensional detail (13) cooperating for an upwards articulation, therefore, operating as locking components between the cap and the bottle. In other words, when screwing the cap to the neck, the blades articulate upwards to an almost vertical position. However, this articulation occurs only while the blades are passing through a sealing neck or circular collar existent in the neck of the bottle. After passing through the circular collar, the blades tend to return to the horizontal position which implies that each blade is inclined inwards, and leaned on the wall of the bottleneck, while its free end remains attached under the bottleneck's collar, characterizing an irreversible locking between the cap and the bottle. When unscrewing the cap, the sealing belt (8) and the cap (1) will separate, as these two pieces are interconnected through the breakable points (11). The breakable points are disrupted, or ruptured, only when the cap is unscrewed, retaining the sealing belt (8) below the collar of the neck, while the cylindrical base (1) or cap is removed, characterizing the first opening of the bottle.

Each blade (12) presents at least one anti-attrition flange or thread (14) in its lower part, which is leaned on the wall of the bottleneck of the, provided that each thread (14) is developed medianly (attached along a central axis), extending from the base of the blade to its distal end.

The anti-attrition thread (14) presents a cross section of any geometric shape, preferably rectangular or semi-circular.

Each blade (12) comprises two or more threads (14), depending on its width.

The thread (14) is an important detail in each vane, as during the application of the cap using high-speed machines, the coupling of the cap occurs with reduced attrition, as the contact area between the vane and the bottleneck or the edge of the collar of the bottleneck is limited only to the flange (14).

On the other hand, with the introduction of the thread, the blade was strengthened, or reinforced, as the thread serves to function as reinforcement. Therefore, even if said vane has a reduced thickness, its locking effect is efficiently maintained.

As demonstrated in FIGS. 5 to 8, each breakable element (11) is presented as a vertical bridge (15) orthogonally crossing the cut line (10) and emerging in the internal surface of the cap. The breakable elements (11) accordingly extend to a length sufficient to attach its upper half portion to the cylindrical base (1), while attaching the lower half portion to the sealing belt (8), maintaining it interconnected to the cylindrical base (1).

According to a selected configuration, the cut line (10) separates the cylindrical base (1) and the sealing belt (8), in order to maintain these two parts joined only through bridges (15).

In a constructive variation, the cut line (10) invades part of **(10*a*) the thickness of each bridge (15), weakening it, however without jeopardizing the integrity of union between the cylindrical base (1) and the sealing belt (8)**.

In other selected configuration (FIG. 3), the cut line (10) includes an interrupted portion (16) of interconnection between the cylindrical base (1) and the sealing belt (8). In this case, upon the opening of the cap, the belt remains attached to the cap The characteristic of this invention is that the sealing belt (8) includes a lower and an upper end, and a plurality of breakable weakening points (17) vertically accompanying the moulding of the cap. The breakable weakening points (17) are distributed, equidistantly or not, implying a reduction on the thickness of the sealing belt (8) from the lower end to a portion slightly above the cut line (10), creating vertical rupture points (18).

Each rupture point (18) is composed of an internal notch (19) and an external notch (20), both vertical and aligned to each other.

In a selected configuration, the internal notch (19) has a V-type cross-section, where its vertex is directed perpendicularly to the thickness of the wall of the sealing belt.

In the selected configuration, the external notch (20) has a square type cross-section, with is bottom face aligned vertically to the notch vertex (19).

In other selected configuration, the external notch (20) has a V-type cross-section, similarly to the internal notch (19).

Figure 7:
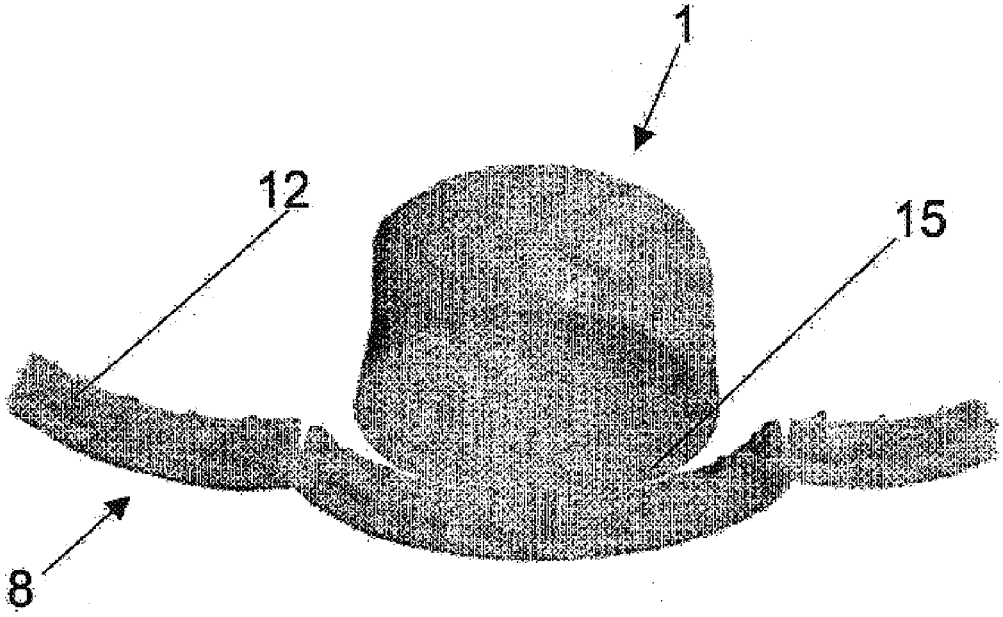
FIG. 7 consists in a perspective of the cap in screen, demonstrating a tampered sealing device.
Figure 8:
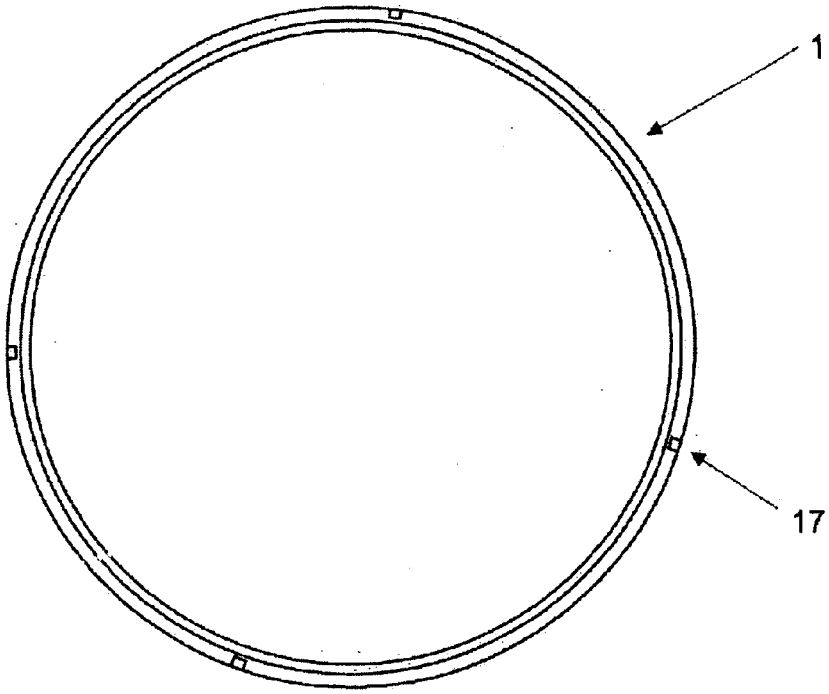
FIG. 8 is a perpendicular view of the sealing belt, above the articulated blades.
Figure 9:
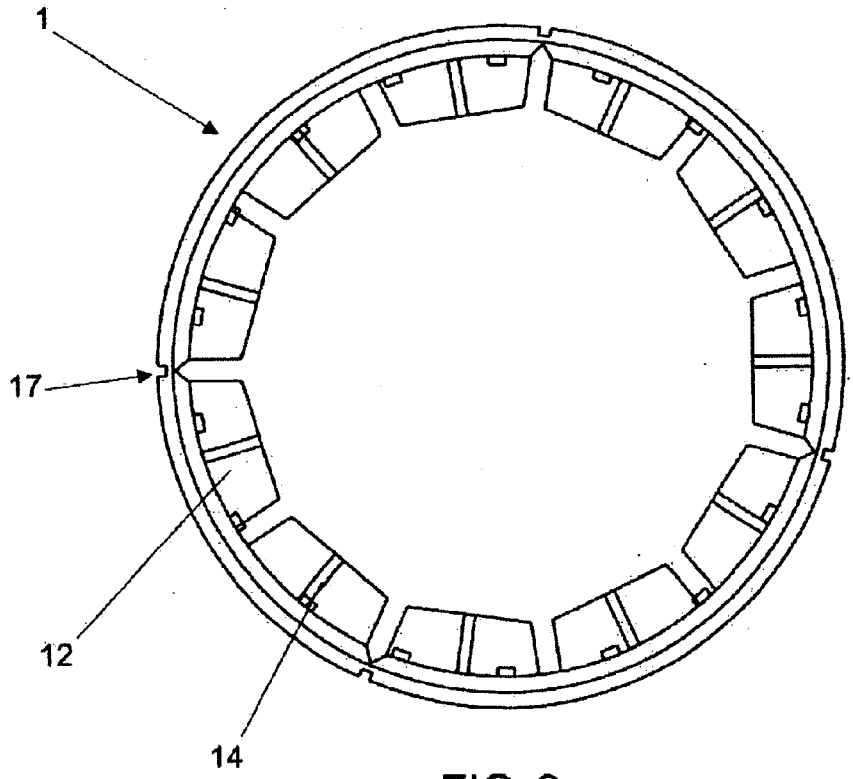
FIG. 9 is a perpendicular view of the sealing belt, below the articulated blades.

Pursuant to the description above, it is possible to verify that this invention fulfills different objectives and verifies the violation of the cap, as of FIG. 7, where is possible to verify a cap already used, and in this condition, the sealing belt is completely destroyed, forming broken segments, which impedes its reassembling in the neck of the bottle, and consequently, this cap contributes to maintain the integrity of the content of the bottle to the final consumer.

It should be understood that the preferred embodiments mentioned here are merely illustrative of the present invention. Numerous variations in design and use of the present invention may be contemplated in view of the following claims without straying from the intended scope and field of the invention herein disclosed.

Having thus described the invention, what is claimed as new and secured by Letters Patent is:

1. A tamper-proof cap for bottles, said cap comprising:

a cylindrical single piece injected in plastic material, including:

a cylindrical vertical base, including an external anti-sliding surface, an internal adequate thread interrupted by sections, a superior end completely closed by a circular wall with a round shape edge, a respective sealing layer placed against the circular wall and a lower end; and a circular sealing belt connected to the cylindrical vertical base lower end, including:

a wall, presenting an outwards slight increase on the thickness;

an internal surface;

an external surface;

an upper end;

a lower end;

a circular cut line above said thickening, said cut line interrupted by breakable elements; and a plurality of articulated blades adjacent to the lower end, said blades equidistantly spaced, presenting at least one anti-attrition thread radially inwards projected, a plurality of flanges and a base configured with a dimensional detail operating as a locking component between the cap and the bottle, wherein the sealing belt includes a plurality of breakable weakening points vertically accompanying the moulding of the cap, reducing the thickness of said sealing belt from the sealing belt lower end to a portion slightly above the cut line, creating vertical rupture points.

2. The tamper-proof cap for bottles as claimed in claim 1, wherein the plurality of breakable weakening points are equidistantly distributed.

3. The tamper-proof cap for bottles as claimed in claim 1, wherein the plurality of breakable weakening points are not equidistantly distributed.

4. The tamper-proof cap for bottles as claimed in claim 1, wherein the rupture points are formed by an internal notch and an external notch, both vertical and aligned to each other.

5. The tamper-proof cap for bottles as claimed in claim 4, wherein the internal notch presents a V-type cross section, with a vertex perpendicularly directed against the thickness of the wall of the sealing belt and the external notch presents a square-type cross-section, with a bottom face vertically aligned with the vertex of the internal notch, with the rupture points between thereof.

6. The tamper-proof cap for bottles as claimed in claim 4, wherein the internal notch presents a V-type cross-section, with a vertex perpendicularly directed against the thickness of the wall of the sealing belt and the external notch presents a V-type cross section, with a vertex perpendicularly directed against the thickness of the wall of the sealing belt, with the rupture points between thereof.

* * * * *